United States Patent [19]

Miller et al.

[11] 4,456,526

[45] Jun. 26, 1984

[54] METHOD FOR MINIMIZING FOULING OF HEAT EXCHANGERS

[75] Inventors: Richard F. Miller, Humble; Ting S. L. Go, Houston, both of Tex.

[73] Assignee: Atlantic Richfield Company, Los Angeles, Calif.

[21] Appl. No.: 423,408

[22] Filed: Sep. 24, 1982

[51] Int. Cl.[3] ..... C10G 9/16

[52] U.S. Cl. ..... 208/48 AA; 44/72

[58] Field of Search ..... 208/48 AA; 585/4; 252/51.5 R, 392; 44/72

[56] References Cited

U.S. PATENT DOCUMENTS

| | | | |
|---|---|---|---|
| Re. 26,330 | 1/1968 | Colfer | 208/48 AA |
| 2,382,818 | 8/1945 | Rhodes et al. | 252/392 |
| 3,340,160 | 9/1967 | Waldby | 208/48 AA |
| 3,366,702 | 1/1968 | Moriarty | 585/648 |
| 3,437,583 | 4/1969 | Gonzalez | 208/48 AA |
| 3,556,983 | 1/1971 | Kronig et al. | 208/48 AA |
| 3,654,129 | 4/1972 | Bloch | 208/48 AA |
| 3,756,943 | 9/1973 | Hopkins | 208/48 AA |
| 3,763,018 | 10/1973 | Raff et al. | 208/48 AA |
| 3,775,493 | 11/1973 | Simone et al. | 208/48 AA |
| 4,011,057 | 3/1977 | Sayers | 44/72 |
| 4,350,606 | 9/1982 | Cuisia et al. | 252/392 |

FOREIGN PATENT DOCUMENTS

| | | | |
|---|---|---|---|
| 2304686 | 10/1976 | France | 252/392 |
| 662698 | 5/1979 | U.S.S.R. | 208/48 AA |

*Primary Examiner*—Delbert E. Gantz
*Assistant Examiner*—Cynthia A. Prezlock
*Attorney, Agent, or Firm*—C. R. Reap; D. M. Kozak; J. C. Martin, Jr.

[57] ABSTRACT

Hydrocarbon process equipment is protected against fouling by incorporating into the hydrocarbon being processed small amounts of a composition comprised of a dialkylhydroxylamine and a tertiary alkylcatechol.

14 Claims, No Drawings

METHOD FOR MINIMIZING FOULING OF HEAT EXCHANGERS

FIELD OF INVENTION

This invention relates to antifoulants and to a method of inhibiting fouling in petroleum or petroleum derivative processing equipment by injecting an antifoulant composition into a feed stream of the material being processed.

BACKGROUND

Fouling of heat transfer surfaces of petroleum processing equipment occurs continuously during the period when petroleum or its derivatives are being processed in the equipment. The fouling is caused by the gradual buildup of a layer of high molecular weight polymeric material resulting from the thermal polymerization of unsaturated materials which are present in the petroleum. As time goes by, fouling continues with the attendant loss of heat transfer until finally the point is reached where it becomes necessary to take the equipment out of service for cleaning. Cleaning is expensive and time consuming, consequently methods of preventing fouling, or at least significantly reducing the rate of fouling, are constantly being sought.

The most economical method of reducing the fouling rate in process heat transfer equipment is to add chemicals which inhibit fouling, called "antifoulants", to the feed stream being processed. Among the more interesting classes is of chemical compounds which exhibit antifoulant activity are the dialkylhydroxylamines. Their use to inhibit polymerization has been described in several patents.

PRIOR ART

U.S. Pat. No. 3,148,225, issued to Albert, employs dialkylhydroxylamines for inhibiting popcorn polymer formation in styrene-butadiene rubbers. The dialkylhydroxylamine compounds appear to react with and terminate free radicals which cause undesired formation of polymer. U.S. Pat. No. 2,965,685, issued to Campbell, discloses inhibiting polymerization by adding about 5 ppm to 5 percent dialkylyhydroxyamine to styrene monomer. Sato et al, in U.S. Pat. No. 3,849,498, teach the use of diethylhydroxylamine as a polymerization inhibitor for an alcoholic solution of unsaturated aldehydes. Mayer-Mader et al, U.S. Pat. No. 3,878,181, employ diethylhydroxylamine either alone or in combination with a water soluble amine such as triethanolamine to terminate the aqueous emulsion polymerization of chloroprene.

It has now been discovered that mixtures of N,N-dialkylhydroxylamines and tertiary alkyl pyrocatechols, commonly referred to as tertiary alkylcatechols, provide outstanding antifoulant protection for petroleum and petroleum derivative processing equipment. Thus, because of the synergistic effect of these mixtures it is now possible to provide unexpectedly superior antifouling protection with the same total equivalent weight of N,N-dialkylhydroxylamines and tertiary alkylcatechol mixtures than can be obtained by the use of members of either of these groups of compounds by themselves.

Accordingly, it is an object of the invention to present new petroleum processing equipment antifoulant compositions. It is another object of the invention to present a method of enhancing the antifouling protection of petroleum processing equipment. These and other objects of the invention are set forth in the following description and examples of the invention.

SUMMARY OF THE INVENTION

The improved antifoulant compositions of the invention are comprised of mixtures of one or more dialkylhydroxylamines, each alkyl group of which has 2 to 10 carbon atoms, and one or more tertiary alkylcatechols, the tertiary alkyl group of which has 4 to 20 carbon atoms. In a preferred embodiment of the invention the antifoulant composition is dissolved in an organic solvent and the resulting solution is continuously injected into a stream of petroleum at a point which is upstream from the equipment which is to be protected.

DETAILED DESCRIPTION OF THE INVENTION

The N,N-dialkylhydroxylamine compounds used in the invention have the structural formula

RR'NOH wherein R and R' are the same or different straight or branched-chain alkyl groups having 2 to about 10, and preferably 2 to 6, carbons atoms. Although N,N-dialkylhydroxylamines having more than about 10 carbon atoms in each alkyl group may be useful in the invention it is preferred that compounds containing 10 or fewer carbon atoms in each alkyl group be used in the invention because the latter compounds are commercially available. Mixtures of two or more N,N-dialkylhydroxylamines can also be advantageously used in the compositions of the invention.

Suitable N,N-alkylhydroxylamines include N,N-diethydroxylamine, N,N-dibutylhydroxylamine, N,N-butylethylhydroxylamine, N,N-didecylhydroxylamine, N,N-2-ethylbutyloctylhydroxylamine, etc. Examples of preferred N,N-dialklyhydroxylamines include N,N-diethylhydroxylamine and N,N-dibutylhydroxylamine. As noted above, two or more of these compounds may be used in combination, if desired.

Tertiary alkylcatechol compounds useful in the invention are those having the structural formula

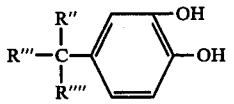

wherein R'', R''' and R'''' are the same or different alkyl groups and the total number of carbon atoms in R'' R''' and R'''' may vary from 3 to 20 or more. The total number of carbon atoms in R'', R''' and R'''' may exceed 20 but no particular advantage is derived from the use of such high molecular weight compounds. The alkyl groups may be straight or branched-chain. Preferred tertiary alkylcatechols are those in which the total number of carbon atoms in R'', R''' and R'''' in the above formula is 3 to 10. Mixtures of two or more tertiary alkylcatechols may be used in the invention if desired.

Suitable tertiary-alkylcatechols include p-(t-butyl)-catechol, p-(1,1-dimethylethyl)catechol, p-(1-ethyl-1-methyl hexyl)catechol, p-(1,1-diethylpropyl)catechol, p-tributylmethylcatechol, p-trihexylmethylcatechol, etc. Preferred tertiary-alkylcatechols include p-(t-butyl)catechol, p-(1,1-diethylethyl)catechol, etc.

Some N,N-dialkylhydroxylamines, such as N,N-diethylhydroxylamine, and tertiary-alkylcatechols, such as p-tertiary-butyl catechol, are available commercially. Those N,N-dialkylhydroxylamines and tertiary-alkylcatechols which are not commercially available may be prepared by any of the well known techniques. The preparation of these compounds forms no part of the present invention.

The concentration of N,N-dialkylhydroxylamine to tertiary alkylcatechol in the compositions of the invention is generally in the range of about 10 to 90 weight percent N,N-dialkylhydroxylamine and 90 to 10 weight percent tertiary-alkylcatechol, based on the total combined weight of these components. In perferred embodiments the concentrations generally fall in the range of about 25 to 75 weight percent N,N-dialkylhydroxylamine and 75–25% tertiary-alkylcatechol, based on the total combined weight of these components.

The antifoulant compositions of the invention may include other additives, if desired. For example, other antifoulants may be used in combination with the above antifoulants of this invention, or dispersants, corrosion inhibitors etc. may be combined with the above antifoulant to improve the efficiency of these compositions or to provide additional protection to the process equipment.

The antifoulant compositions of the invention can be introduced into the equipment to be protected by any conventional method. It is generally introduced just upstream of the point of desired application by any suitable means, such as by the use of a proportionating pump. The antifoulant composition may be added as a concentrate but it is preferable to add it as a solution or a slurry in a liquid diluent which is compatible with the stream being treated. Suitable solvents include kerosene, naphtha, the lower alkanes such as hexane, aromatic solvents, such as toluene, etc. The concentration of antifoulant in the solvent is desirably in the range of about 1 to 30 weight percent and perferably about 5 to 20 weight percent based on the total weight of antifoulant and solvent.

The antifoulant is used at the concentration which is effective to provide the desired protection against fouling. It has been determined that amounts of antifoulant in the range of about 0.5 to 1000 ppm based on the weight of the petroleum or petroleum derivative stream being treated afford ample protection against fouling. For most applications the inhibitor is used in amounts in the range of about 1 to 100 ppm.

The following examples will serve to further illustrate the invention. Unless otherwise stated, parts and percentages are on a weight basis.

In the examples the thermal fouling determinations were made using a Jet Fuel Thermal Oxidation Tester marketed by Alcor, Inc. The specifications of this apparatus are set forth in ASTM D3241-74T. In general the apparatus consists of reservoir to hold the hydrocarbon liquid being tested, an electrically heated tubular heater and a precision stainless steel filter. Tubular conduit connects the reservoir with the heater and the heater with the filter. Pressure gauges are provided for measuring the pressure drop across the filter. A thermocouple and a temperature controller are provided for precise control of the temperature of the liquid passing through the heater.

In operation, a hydrocarbon oil is pumped through the heater, which has adequate heat transfer surface to maintain the heater effluent at a predetermined temperature in the range of about 250° to 900° F. As the hydrocarbon passes through the heater a film of polymeric residue builds up on the inside of the heater. Particles of the residue slough off the surface of the heater tube and are caught in the filter. As the filter clogs up the pressure drop across the filter increases. The fouling rate in the heater is approximated by measuring the rate of pressure build-up across the filter. The test is terminated when the pressure drop reaches a predetermined value. The equipment is dismantled and thoroughly cleaned after each run.

In the following examples antifoulant effectiveness is measured by comparing the time required for the pressure drop of a hydrocarbon stream containing the antifoulant to reach a certain value with the time required for the pressure drop of a stream of the same hydrocarbon but without the antifoulant to reach the same pressure drop value. The hydrocarbon stream used in the examples was the bottoms product obtained from a depentanizer. This product consists primarily of light hydrocarbons, i.e. up to about 8 carbon atoms, from which have been removed all $C_5$ and lighter hydrocarbons. This feedstock was selected because depentanizer bottoms streams usually contain higher unsaturated materials which cause fouling in the depentanizer tower and associated heat exchangers.

EXAMPLE

A series of antifoulant effectiveness tests were conducted using depentanizer bottoms as the hydrocarbon carrier liquid. The tests were carried out using a hydrocarbon flow rate through the heater of about 240 ml per hour with the heater effluent temperature maintained at 600° F. The tests were terminated when the pressure drop across the filter reached 50 mm. Hg. Run 1 was carried out using uninhibited hydrocarbon; Runs 2, 3 and 4 were carried out using the same hydrocarbon as was used in Run 1 but modified by the addition of 50 ppm of tertiary butylcatechol, diethyl hydroxylamine and a 50/50 mixture of tertiary butylcatechol and diethyl hydroxylamine respectively. The results are tabulated in the following table.

TABLE

COMPARATIVE ANTIFOULANT ACTIVITIES

| Test Time (Minutes) | Run 1 (Blank) | Run 2 TBC | Run 3 DEHA | Run 4 TBC/DEHA |
|---|---|---|---|---|
| 0 | 0 | 0 | 0 | 0 |
| 22 | — | 2 | — | — |
| 28 | — | 10 | — | — |
| 30 | 0 | 14 | 2 | 0 |
| 31 | — | 15 | — | — |
| 36 | — | 25 | — | — |
| 44 | 2 | — | — | — |
| 50 | 10 | — | — | — |
| 53 | 15 | — | — | — |
| 55 | — | 50 | — | — |
| 58 | 25 | — | — | — |
| 60 | 29 | — | [illegible] | 2 |
| 83 | 50 | — | — | — |
| 90 | — | — | [illegible] | 4 |
| 98 | — | — | 0 | — |
| 110 | — | — | 5 | — |
| 120 | — | — | 10 | [illegible] |
| 132 | — | — | 15 | — |
| 143 | — | — | — | 10 |
| 150 | — | — | 43 | 10 |

The foregoing example illustrates the benefits derived by the use of the antifoulant composition of the invention. In the control (Run 1) the test was terminated at 83 minutes due to excessive fouling. The result obtained when using t-butylcatechol was inferior to the control and was terminated at 55 minutes due to fouling. Run 3, in which diethyl hydroxylamine was used, showed an improvement over the control. In this run, the entire test volume (600 ml) of hydrocarbon was used. The pressure drop across the filler due to fouling at the end of this test was 43 mm Hg. The result obtained in Run 4 was far superior to the result obtained in either of the three prior runs. The test was terminated after the entire volume (600 ml) of hydrocarbon was used. The final pressure drop in this run was only 10 mm Hg, a more than four-fold improvement over the result observed in the next best test, Run 3.

Although the invention is described with particular reference to specific examples, the scope of the invention is limited only by the breadth of the appended claims.

What is claimed is:

1. An antifoulant composition comprising (a) an antifoulant system comprised of 10 to 90 weight percent of at least one N,N-dialkylhydroxlamine wherein the alkyl groups are the same or different and each alkyl group has 2 to 10 carbon atoms, and about 90 to 10 weight percent of at least one tertiary-alkylcatechol having 4 to 20 alkyl carbon atoms and (b) an inert solvent for said antifoulant system selected from kerosene, naphtha, lower alkanes, aromatic compounds and mixtures of these.

2. The composition of claim 1 wherein the concentrations of N,N-dialkylhydroxylamine and tertiary alkylcatechol are in the ranges of 25 to 75 and 75 to 25 weight percent respectively.

3. The composition of claim 2 wherein each alkyl group of the N,N-dialkylhydroxylamine has 2 to 6 carbon atoms and the tertiary-alkylcatechol has 4 to 8 alkyl carbon atoms.

4. The composition of claim 3 wherein the N,N-dialkylhydroxylamine is N,N-diethylhydroxylamine and the tertiary-alkylcatechol is t-butyl catechol.

5. An antifoulant composition comprised of:

(a) about 70 to 95 parts by weight of an inert organic solvent selected from kerosene, naphtha, alkanes having 5 to 10 carbon atoms, aromatic compounds and mixtures of these, and (b) about 5 to 30 parts by weight of a mixture comprised of:

(1) about 10 to 90 parts by weight of at least one N,N-dialkylhydroxylamine wherein the alkyl groups are the same or different and each alkyl group has 2 to 10 carbon atoms, and (2) about 90 to 10 parts by weight of at least one tertiary-alkylcatechol having 4 to 20 carbon atoms.

6. The composition of claim 5 wherein each alkyl group in (1) has 2 to 6 carbon atoms, the tertiary alkyl group in (2) has 4 to 8 carbon atoms and the relative concentrations of the compounds in (1) and (2) are 25 to 75 parts by weight and 75 to 25 parts by weight respectively.

7. The composition of claim 6 wherein the solvent in (a) is kerosene, the compound in (1) is N,N-diethylhydroxylamine and the compound in (2) is tertiary butylcatechol.

8. In a method of inhibiting fouling in petroleum processing equipment comprising injecting into a petroleum or petroleum derivative feed stream to said equipment an amount of antifoulant effective to substantially reduce the rate of fouling, the improvement comprising using as the antifoulant a composition comprised of:

(a) about 10 to 90 parts of at least one N,N-dialkylhydroxylamine wherein the alkyl groups are the same or different and each alkyl group has 2 to 10 carbon atoms, and (b) about 90 to 10 parts of at least one tertiary alkylcatechol having 4 to 20 alkyl carbon atoms, per 100 total parts by weight of the compounds in (a) and (b).

9. The improved method of claim 8 wherein the antifoulant composition is injected into the feed stream in a concentration of about 0.5 to 1000 ppm based on the weight of said feed stream.

10. The improved method of claim 9 wherein each alkyl group of the compound in (a) has 2 to 6 carbon atoms and the tertiary alkyl group of the compound in (b) has 4 to 8 carbon atoms.

11. The improved method of claim 10 wherein the compound in (a) is N,N-diethythydroxylamine and the compound in (b) is tertiary-butylcatechol.

12. The improved method of claim 8, 9, 10, or 11 wherein the compounds in (a) and (b) are present in amounts of about 25 to 75 parts and 75 to 25 parts by weight, respectively.

13. The improved method of claim 12 wherein the antifoulant is dissolved in an inert organic solvent.

14. The improved method of claim 13 wherein the antifoulant is added to the feed stream at a concentration of about 1 to 100 parts per million parts of feed stream.

* * * * *